US006850218B2

(12) United States Patent
Waterman

(10) Patent No.: US 6,850,218 B2
(45) Date of Patent: Feb. 1, 2005

(54) FRAME PREWRITING IN A LIQUID CRYSTAL DISPLAY

(75) Inventor: John Karl Waterman, Mesa, AZ (US)

(73) Assignee: Brillian Corporation, Tempe, AZ (US)

( * ) Notice: Subject to any disclaimer, the term of this patent is extended or adjusted under 35 U.S.C. 154(b) by 374 days.

(21) Appl. No.: 09/740,287

(22) Filed: Dec. 18, 2000

(65) Prior Publication Data

US 2002/0075221 A1 Jun. 20, 2002

(51) Int. Cl.[7] ..... G09G 3/36
(52) U.S. Cl. ..... 345/103; 345/87
(58) Field of Search ..... 345/87–104; 349/73

(56) References Cited

U.S. PATENT DOCUMENTS 5,892,493 A * 4/1999 Enami et al. ..... 345/94
6,014,193 A * 1/2000 Taira et al. ..... 349/73
6,232,938 B1 * 5/2001 Tsuchida et al. ..... 345/88
6,320,565 B1 * 11/2001 Albu et al. ..... 345/98

FOREIGN PATENT DOCUMENTS

EP 0 984 423 A2 3/2000 ..... G09G/3/36

OTHER PUBLICATIONS

International Search Report; PCT/US 01/48959. May 2, 2003.

* cited by examiner

*Primary Examiner*—Dennis-Doon Chow
*Assistant Examiner*—Srilakshmi K. Kumar
(74) *Attorney, Agent, or Firm*—Baker Botts L.L.P.

(57) ABSTRACT

A liquid crystal display (LCD) having a matrix of liquid crystal pixels is provided. A plurality of digital-to-analog converters (DACs) are coupled to the LCD matrix through analog voltage switches and are adapted to produce output voltages that are applied to the pixels in the LCD matrix. Through the combination of DACs and analog voltage switches, groups of pixels are pre-written to an average value of the pixels in that group which is fairly close to their final voltage values of each pixel so that the liquid crystal material can begin slewing and settling as early as possible. Then one or more writes to each of the pixels is made of the precise voltage value desired at each of the pixels. Alternate, adjacent odd and even rows of pixels may be written together and then only the even or odd rows are finally written to obtain the desired final voltage values at each of the pixels in the LCD.

36 Claims, 6 Drawing Sheets

FRAME PREWRITING IN A LIQUID CRYSTAL DISPLAY

FIELD OF THE INVENTION

The present invention relates generally to liquid crystal display devices, and more particularly to a system and method for more accurately and quickly writing a frame of video information to a liquid crystal display comprising a plurality of pixels.

BACKGROUND OF THE INVENTION

Liquid crystal displays (LCDs) are commonly used in devices such as portable televisions, portable computers, control displays, and cellular phones to display information to a user. LCDs act in effect as a light valve, i.e., they allow transmission of light in one state, block the transmission of light in a second state, and some include several intermediate stages for partial transmission. When used as a high resolution information display, as in one application of the present invention, LCDs are typically arranged in a matrix configuration with independently controlled pixels (the smallest segment of the display). Each individual pixel is signaled to selectively transmit or block light from a backlight (transmission mode), from a reflector (reflective mode), or from a combination of the two (transflective mode).

A LCD pixel can control the transference for different wavelengths of light. For example, an LCD can have pixels that control the amount of transmission of red, green, and blue light independently. In some LCDs, voltages are applied to different portions of a pixel to control light passing through several portions of dyed glass. In other LCDs, different colors are projected onto the pixel sequentially in time. If the voltage is also changed sequentially in time, different intensities of different colors of light result. By quickly changing the wavelength of light to which the pixel is exposed an observer will see the combination of colors rather than sequential discrete colors. Several monochrome LCDs can also result in a color display. For example, a monochrome red LCD can project its image onto a screen. If a monochrome green and monochrome blue LCD are projected in alignment with the red, the combination will be full color.

The monochrome resolution of an LCD can be defined by the number of different levels of light transmission that each pixel can perform in response to a control signal. A second level is different from a first level when the user can tell the difference between the two. An LCD with greater monochrome resolution will look clearer to the user.

LCDs are actuated pixel-by-pixel, either one at a time or several simultaneously. A voltage is applied to each pixel and the liquid crystal responds to the voltage by transmitting a corresponding amount of light. In some LCDs an increase in the actuation voltage decreases transmission, while in others it increases transmission. When multiple colors are involved for each pixel, multiple voltages are applied to the pixel at different positions or times depending upon the LCD. Each voltage controls the transmission of a particular color. For example, one pixel can be actuated to allow only blue light to be transmitted while another allows only green. A greater number of different light levels available for each color results in a much greater number of possible combination colors.

Converting a complex digital signal that represents an image or video into voltages to be applied to the pixels of an LCD involves circuitry that can limit the monochrome resolution. The signals necessary to drive a single color of an LCD are both digital and analog. It is digital in that each pixel requires a separate selection signal, but it is analog in that an actual voltage is applied to the pixel to determine light transmission.

Each pixel in the core array of the LCD is addressed by both a column (vertical) driver and a row (horizontal) driver. The column driver turns on an analog switch that connects an analog voltage representative of the video input (control voltage necessary for the desired liquid crystal twist) to the column, and the row driver turns on a second analog switch that connects the column to the desired pixel.

The video inputs to the LCD are analog signals centered around a center reference voltage of typically from about 7.5 to 8.0 volts. This center reference voltage is not a supply or signal from anywhere, rather it is a mathematical entity. This center reference voltage is called "VCOM" and connects to the LCD cover glass electrode which is a transparent conductive coating on the inside face (liquid crystal side) of the cover glass. This transparent conductive coating is typically Indium Tin Oxide (ITO).

One frame of video pixels are run at voltages above the center reference voltage (positive inversion) and for the next frame the video pixels are run at voltages below the center reference voltage (negative inversion). This alternating between positive and negative inversions results in a zero net DC bias at each pixel. This removes the "image sticking" phenomena.

Writing video voltage values to each pixel in, for example, an 800×600 (SVGA) frame takes about 2 milliseconds using 8 analog channels in parallel operation, with each analog channel given about 25 nanoseconds to apply the appropriate video voltage value to each of its set of pixels of the SVGA frame. Unfortunately, the liquid crystal material itself takes about 3 to 4 milliseconds to settle to within one percent of its final reflectivity. That leaves very little time to flash the light source (for example: light emitting diodes—LED) for the illumination step. For example, using a three color frame image at 80 Hz, each of the color (red-green-blue) frames at 240 Hz, allows only 4.2 milliseconds per frame. Considering the requirements imposed by frame inversion, and the problem of color-breakup with color-sequential images, 80 Hz is about the slowest rate at which to present images. With increased resolution of present and future LCD display video images, a faster and more accurate way of writing pixels is desired

SUMMARY OF THE INVENTION

The present invention is directed to a system and method for quickly and accurately writing video voltages to the matrix of pixels of a liquid crystal display.

In the embodiments of the present invention, a matrix of liquid crystal pixels is provided. A plurality of digital-to-analog converters (DACs) are coupled to the matrix through analog voltage switches and are adapted to produce output voltages that are applied to the pixels in the matrix. Through the combination of DACs and analog voltage switches, groups of the pixels (sub-matrices) of the pixel matrix are pre-written very quickly yet fairly close to their final voltage values so that the liquid crystal material can begin slewing and settling as early as possible. The embodiment then does another one or more writes to each of the pixels for a precise voltage value at each of the pixels. The LED is flashed to illuminate the LCD frame and then the next color frame starts being written.

According to the embodiments of the present invention, after one frame of a color-sequence color exposure is finished, and the LED is turned off, the next frame is prewritten to coarse groups (sub-matrices) of, for example but not limited to, 8×8 pixels which are preferably written to an average voltage value of the final values of the pixels in that group. This pre-write to the group of pixels preferably may be written in about one sixty-fourth of a normal write time, or about 30 microseconds.

Determination of the average voltage values may be calculated as the pixel value streams enter the control logic of the LCD system. The calculated voltage values may be stored in a memory, such as for example but not limited to, random access memory (RAM) and would require only an additional 1/64 of the RAM storage required for storage of the individual pixel voltage values (for an 8×8 group size). It is contemplated and within the spirit and scope of the invention that many other group sizes may be implemented, and any number of DACs may be used.

In another embodiment of the invention, a plurality of groups may be written with the average values of the pixels in those groups, all at the same time by using the plurality of DACs. Each DAC could write to a respective group during the same time period.

In another embodiment of the invention, the exact pixel voltage values for a frame can be written in two steps, each taking one half the time of writing the frame in the normal line-by-line manner. For example, first the adjacent odd and even rows are written together, using the values for the odd rows. Then a second pass is performed by writing voltage values only to the even rows. The same effect can be accomplished by writing the even row values first, then on the second pass writing values only to the odd rows.

A technical advantage of the present invention is that it more quickly and accurately controls the light characteristics of pixels of a liquid crystal display. Another technical advantage of the present invention is that the voltage slew times are decreased so that each pixel may settle to its final voltage value more quickly. Another technical advantage of the present invention is that it allows faster write times for each frame of the LCD.

Other technical advantages of the present disclosure will be readily apparent to one skilled in the art from the following figures, descriptions, and claims. Various embodiments of the invention obtain only a subset of the advantages set forth. No one advantage is critical to the invention. For example, one embodiment of the present invention may only provide the advantage of controlling the pixels of a liquid crystal display, while other embodiments may provide several of the specified and apparent advantages.

BRIEF DESCRIPTION OF THE DRAWINGS

A more complete understanding of the present disclosure and advantages thereof may be acquired by referring to the following description taken in conjunction with the accompanying drawings, in which like reference numbers indicate like features, and wherein.

DETAILED DESCRIPTION OF THE PREFERRED EMBODIMENTS

Figure 1:
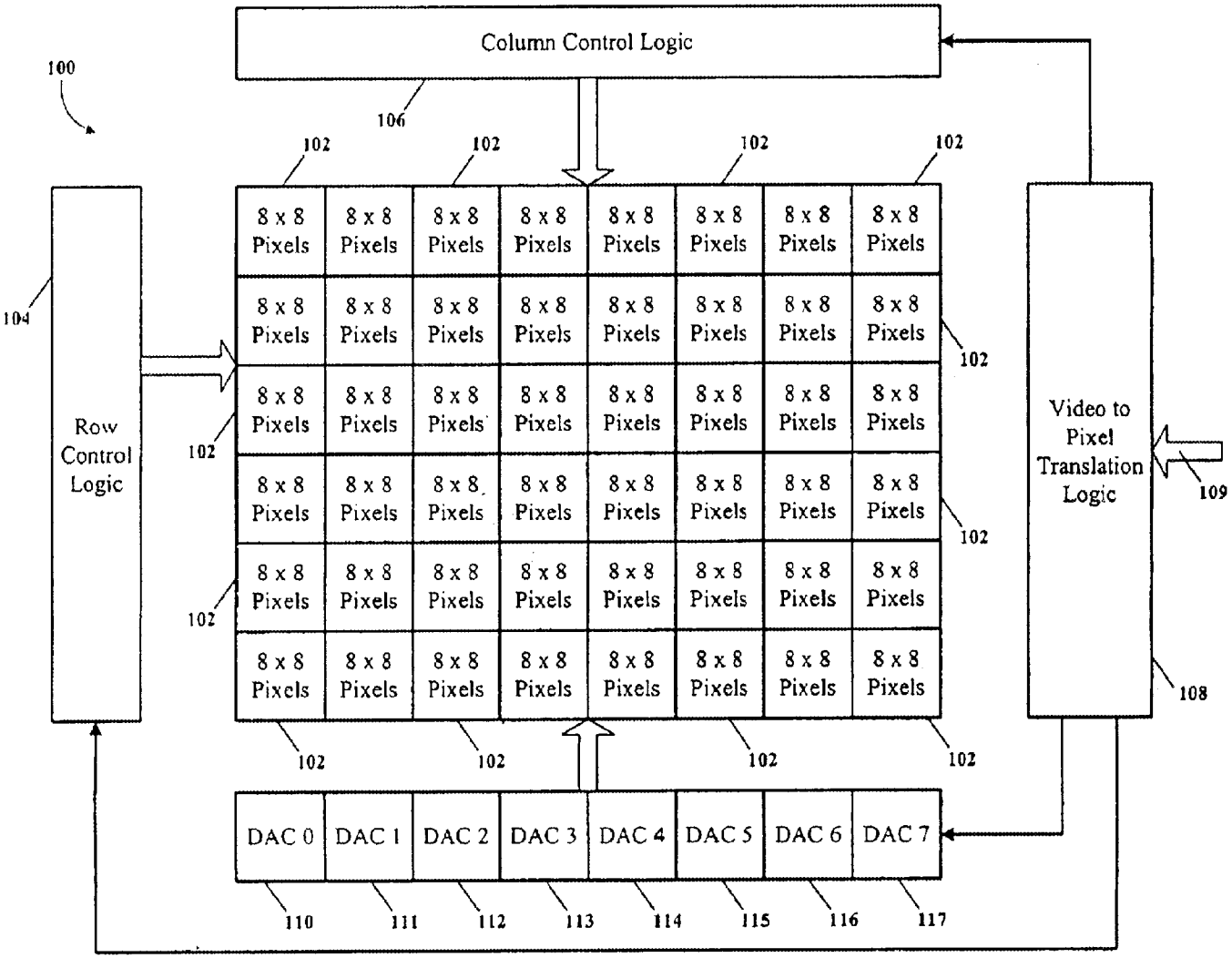
FIG. 1 is a schematic block diagram of a liquid crystal display system in accordance with embodiments of the present invention.

The present invention is directed to liquid crystal display devices having circuits for fast writing to pixels a frame of video information. A group of pixels are first precharged to an average value of the final pixel values then the final pixel values are written to each pixel. A combination of more than one final write cycles may be used to further improve the speed and accuracy of writing to the pixels a frame of video.

Referring now to the drawings, the details of preferred embodiments of the invention are schematically illustrated. Like elements in the drawings will be represented by like numbers, and similar elements will be represented by like numbers with a different lower case letter suffix.

FIG. 1 illustrates a schematic block diagram of a liquid crystal display system in accordance with the embodiments of the present invention. A high-level block diagram of a system for writing voltage values to pixels of a liquid crystal display (LCD) is generally represented by the numeral 100. The voltage values being written to the pixels are representative of a frame of video data. The voltage values control the "twist" of the liquid crystal material at each pixel so that when a light is flashed on or through the LCD, the light polarization and ultimately the intensity of the light is controlled by the "twist" of the liquid crystal material each pixel in the LCD.

For illustrative purposes, the LCD 100 depicted in FIG. 1 comprises 64 pixel columns by 48 pixels rows for a total of 3072 individually addressable pixels. The LCD 100 is further divided into 8×8 pixel groups 102. The combination of row control logic 104 and column control logic 106 are used to select each of the pixels for writing thereto in the LCD 100, as more fully described hereinbelow. Video to pixel translation logic (hereinafter translation logic) 108 performs the necessary calculations and steps to translate a video frame image 109 into discrete digital values which are sent to digital-to-analog converters (DACs) 110, 111, 112, 113, 114, 115, 116 and 117, and the pixel location addresses thereof are sent to the row and column control logic 104 and 106. It is contemplated and within the scope of the present invention that an LCD having any number of rows and columns may benefit from the present invention. In addition, any number of DACs may be used according to embodiments of the present invention.

Figure 2:
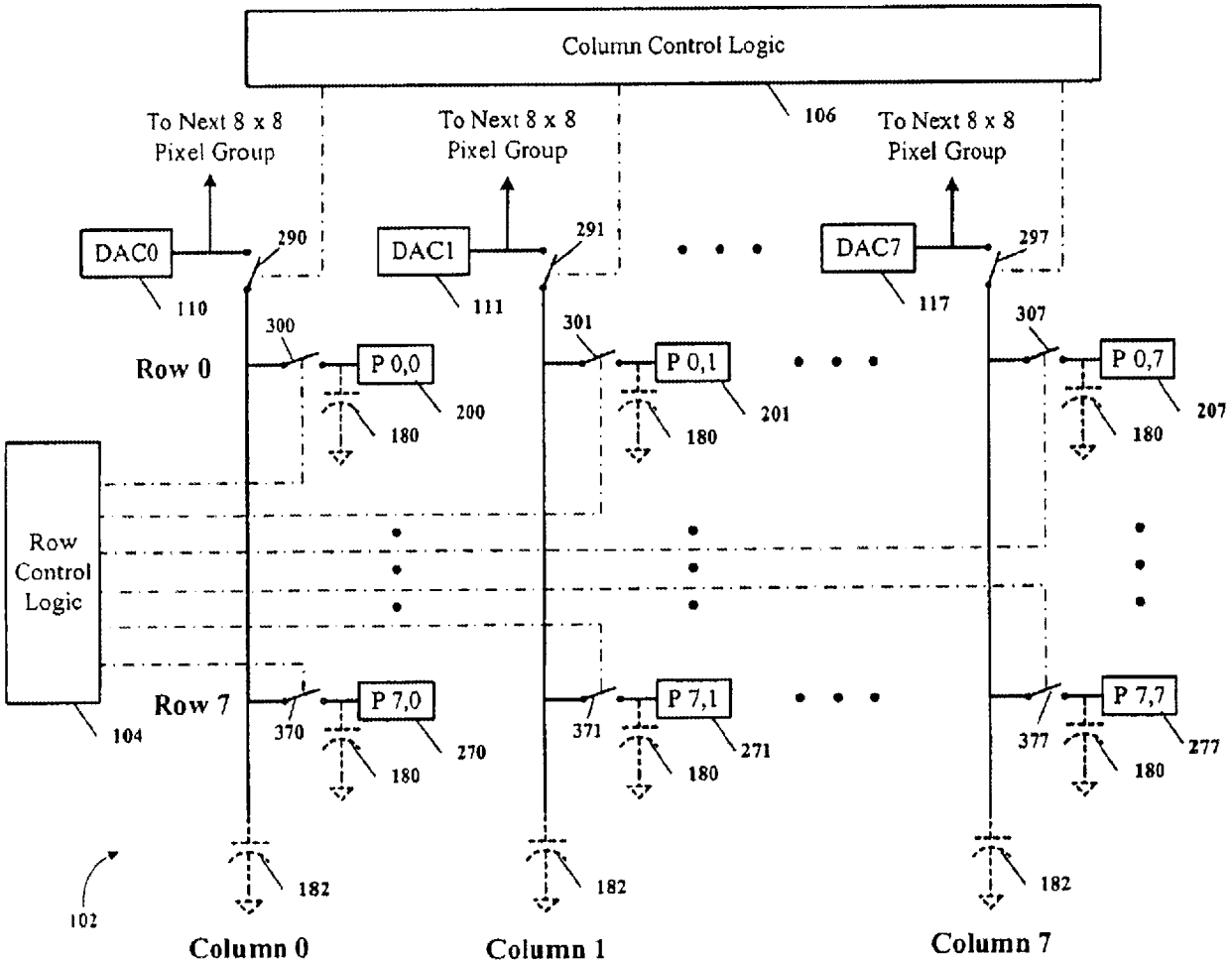
FIG. 2 is a schematic block diagram of a portion of an embodiment of the liquid crystal display of FIG. 1.

Referring now to FIG. 2, a schematic block diagram of a portion of an embodiment of the liquid crystal display system of FIG. 1 is illustrated. An 8×8 pixel group 102 comprises pixels 200 through 277, pixel row switches 300 through 377 and pixel column switches 290 through 297. An LCD operates by applying certain voltage values to each pixel of the LCD. A certain voltage at a pixel causes liquid crystals at that pixel to change their "twist" orientation so that light passing through the LCD or being reflected is thereby affected. The translation logic 108 uses the received video frame information 109 to create appropriate voltage values which are representative of that portion of the video frame at each one of the pixel locations. In addition, the translation logic 108 associates an x-y coordinate (row-column) location for each of these pixel voltage values.

The DACs 110–117 receive digital representations of the voltage values from the translation logic 108 and convert these digital representations to analog voltage values which must then be applied to each corresponding pixel location. Each of the pixels 200–277 has a capacitance 180 associated therewith, and each of the columns has a capacitance 182 associated therewith. The capacitance 180 of each pixel may not all be the same, nor may the capacitance 182 of each column be the same. The column capacitance 182 is greater than the pixel capacitance 180. An analog voltage value must charge the respective column and pixel capacitances to which it is applied. The output of the DAC is connected to the column and thereby fully charges the capacitance to a desired analog voltage, then the pixel is connected to the column and the pixel capacitance is charged from the voltage on the column. Since the column capacitance is greater than the pixel capacitance, the voltage on the pixel will be substantially same as the voltage on the column.

The liquid crystal material also has a finite time constant for orientation by the applied voltage. The voltage applied to each pixel must also be alternately reversed in polarity so that a direct current charge does not develop on the liquid crystal material. All of these factors increase the write time of a pixel necessary for the liquid crystals of the pixels to settle into the desired light modification positions. It is desirable and necessary that the pixel capacitance be charged as quickly as possible so as to maximize the available settling time of the liquid crystal material at each pixel position.

All LCDs charge a column to a certain voltage then select a pixel row so that the intersection thereof is the desired pixel to be charged. For example, columns 0–7 are charged from the DACs 110–117, respectively, when the column switches 290–297 are closed. Pixels 200–207 are charged from the columns 0–7, respectively, when the row switches 300–307 are closed. A plurality of DACs may be used to simultaneously charge a like number of columns, then a like number of switches in a row may be used to charge a like number of pixels from the charged columns. The column control logic 104 and row control logic 106 control operation of the column switches 290–297 and row switches 300–377, respectively, for the pixel group 102. Other pixel groups 102 are controlled in a similar fashion.

An embodiment of the invention determines an average voltage value of an 8×8 pixel group 102, then this average voltage value is simultaneously written to each one of the pixels 200–277 in the pixel group 102. This may be accomplished by sending the digital representation of the average voltage value to the DACs 110–117, then closing column switches 290–297 and row switches 300–377. All of the pixels in the pixel group 102 are thus charged to the average voltage value. Next individual pixels are addressed and charged to each respective pixel voltage value in accordance with the video frame. Slew time is reduced because the final voltage value at each pixel does not have to charge as much as would be the case if, for example, going directly from a positive inversion voltage value to a negative inversion voltage value.

Another embodiment of the invention first charges an entire pixel group 102 as described above, then writes adjacent odd and even rows of pixels together, using the voltage values for the odd rows of pixels. Then a second pass is performed by writing voltage values only to the even rows. The same effect can be accomplished by writing the even row values first, then on the second pass writing values only to the odd rows.

Figure 3:
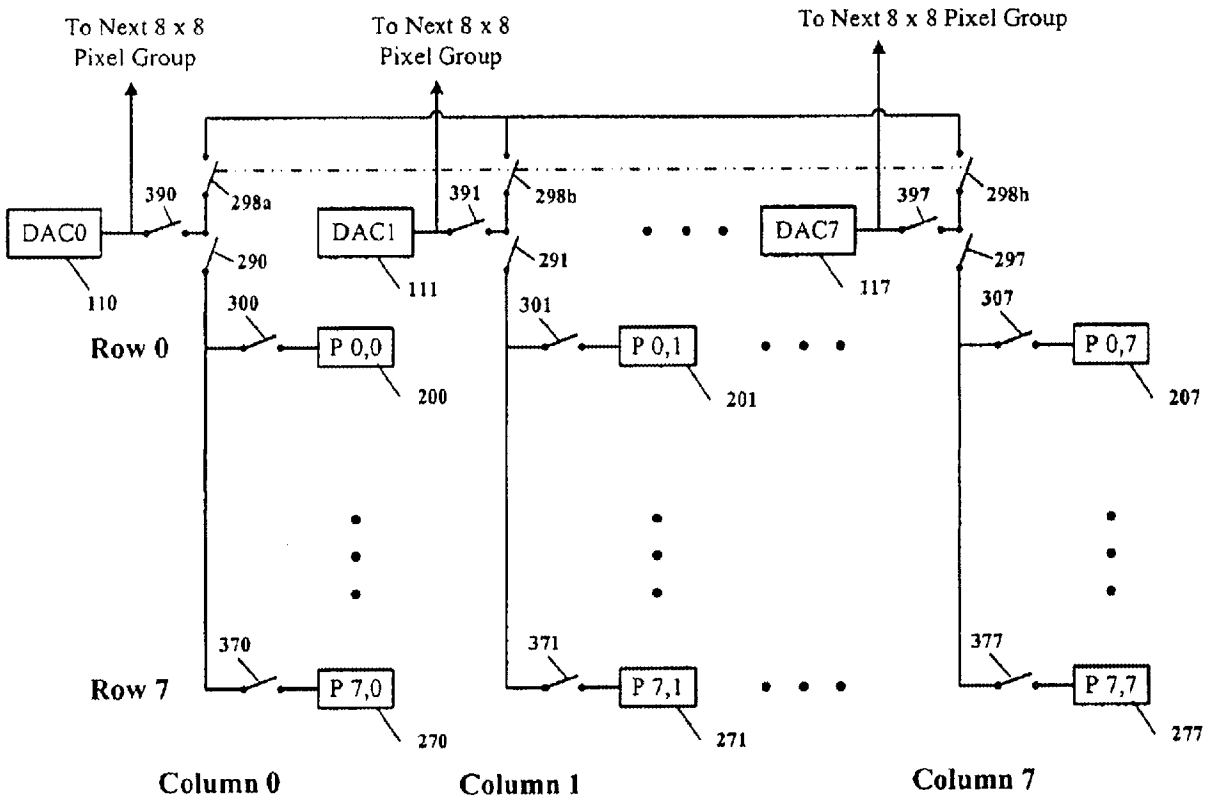
FIG. 3 is a schematic block diagram of another embodiment of the liquid crystal display of FIG. 1.

FIG. 3 illustrates a schematic block diagram of a portion of another embodiment of the liquid crystal display system of FIG. 1. The DACs 0–7 may be used to simultaneously write average voltage values to eight pixel groups 102. Switches 298*a*–298*h* connect or disconnect the DACs 110–117 to common buses of each pixel group 102. This embodiment further increases the available write and settling times for pixels of the LCD 100.

In the embodiments of the present invention, the video to pixel translation logic 108 is adapted to compute average voltage values for each pixel group 102, send addressing information to the row control logic 104 and the column control logic 106. An average voltage value is applied to each of the pixels of the pixel group 102, and then at least one more pass is made to finalize each pixel voltage. This reduces the write settling times of the pixels and improves the image accuracy in a given time period.

Figure 4:
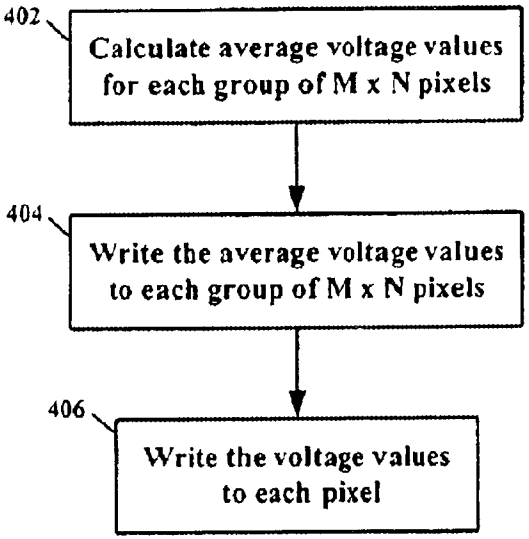
FIG. 4 is a functional flow diagram of the operation of an embodiment of the present invention.

Referring now to FIG. 4, a functional flow diagram of the operation of an embodiment of the present invention is illustrated. In step 402, the average voltage values for each group of pixels is calculated. In step 404, the calculated average voltage values are written to each group of pixels. Then in step 406, the voltage values for each pixel are written thereto.

Figure 5:
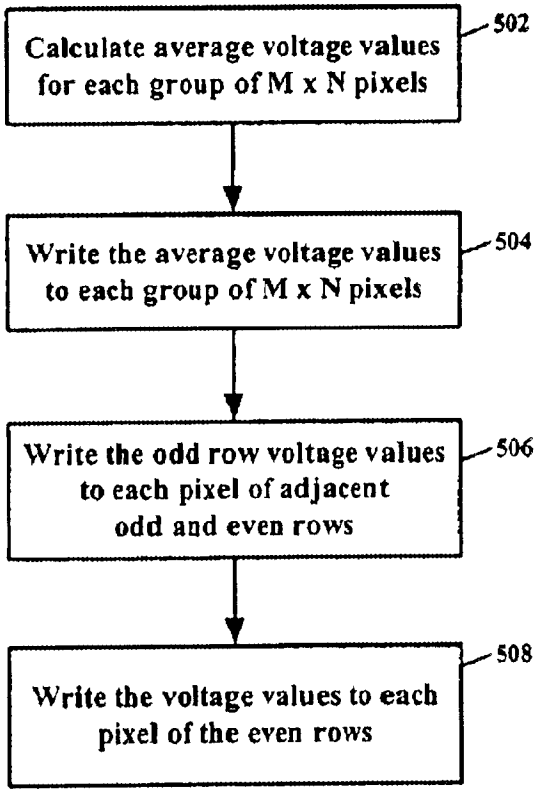
FIG. 5 is a functional flow diagram of the operation of another embodiment of the present invention.

Referring now to FIG. 5, a functional flow diagram of the operation of another embodiment of the present invention is illustrated. In step 502, the average voltage values for each group of pixels is calculated. In step 504, the calculated average voltage values are written to each group of pixels. In step 506, the odd row voltage values are written to each pixel of adjacent odd and even rows. In step 508, the voltage values are written to each pixel of the even rows.

Figure 6:
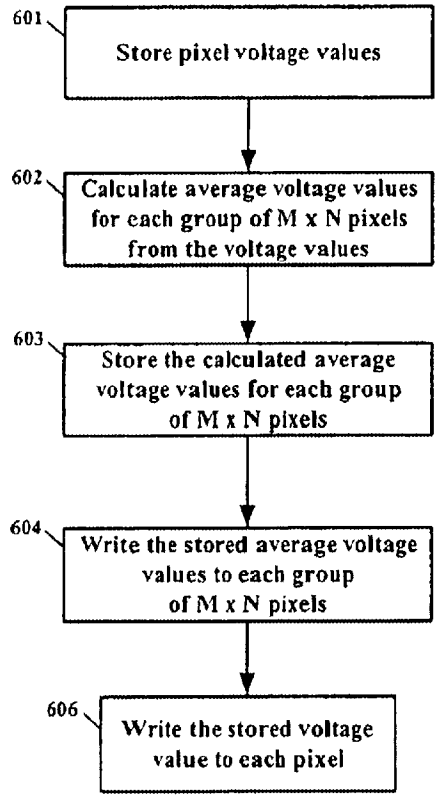
FIG. 6 is a functional flow diagram of the operation of the embodiment of FIG. 4 further comprising memory storage of pixel voltage values and average values.

Referring now to FIG. 6, a functional flow diagram of the operation of the embodiment of FIG. 4 further comprising memory storage of pixel voltage values and average values is illustrated. In step 601, the pixel voltage values are stored in a memory. In step 602, the average voltage values for each group of pixels is calculated. In step 603 the calculated average voltage values for each group of pixels is stored in a memory. In step 604, the calculated average voltage values are written to each group of pixels. Then in step 606, the voltage values for each pixel are written thereto.

Figure 7:
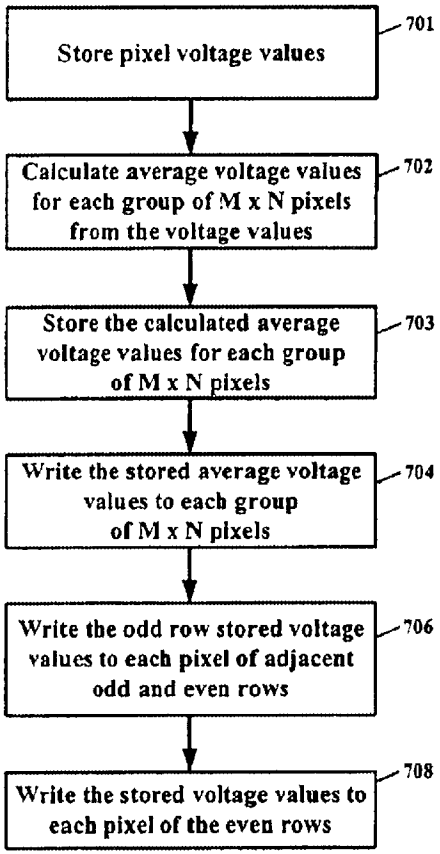
FIG. 7 is a functional flow diagram of the operation of the embodiment of FIG. 5 further comprising memory storage of pixel voltage values and average values.

Referring now to FIG. 7, a functional flow diagram of the operation of the embodiment of FIG. 5 further comprising memory storage of pixel voltage values and average values is illustrated. In step 701, the pixel voltage values are stored in a memory. In step 702, the average voltage values for each group of pixels is calculated. In step 703 the calculated average voltage values for each group of pixels is stored in a memory. In step 704, the stored average voltage values are written to each group of pixels. In step 706, the odd row stored voltage values are written to each pixel of adjacent odd and even rows. In step 708, the stored voltage values are written to each pixel of the even rows.

Figure 8:
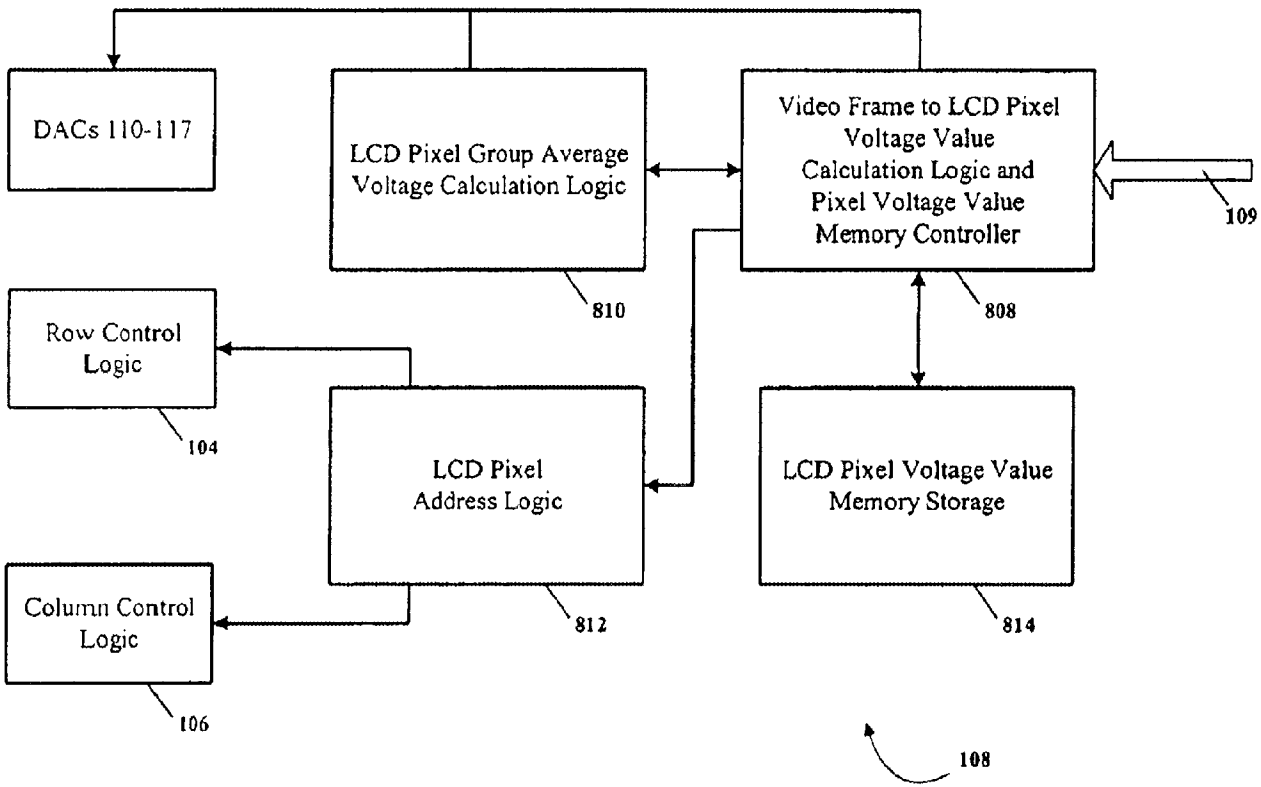
FIG. 8 is a more detailed schematic block diagram of the video to pixel translation logic illustrated in FIG. 1.

Referring to FIG. 8, a more detailed schematic block diagram of the video to pixel translation logic is illustrated. The translation logic 108 comprises a video frame pixel to LCD pixel voltage calculation logic and pixel value memory controller 808, LCD pixel group average voltage calculation logic 810, LCD pixel address logic 812 and LCD pixel voltage value memory storage 814. Video frame information 109 is translated into final voltage values for each pixel of the LCD in the video frame pixel to LCD pixel voltage calculation logic and pixel value memory controller 808, and an average voltage value is found from the pixel final voltage values of each group (102) of pixels in the LCD pixel group average voltage calculation logic 810.

The average voltage values may be directed to the appropriate DACs for each pixel group 102 and then the final voltage values may be directed to the appropriate DACs for each pixel of the LCD system 100. In addition, the average voltage values and the final voltage values may be stored in the memory storage 814 for concurrent use, and/or subsequent use in writing the voltage values to the pixel groups and individual pixels. The LCD pixel address logic 812 controls the row control logic 104 and column control logic 106 so that the analog switches connect the appropriate DAC outputs for maximum efficiency in reducing slew time and pixel writing speed.

It is contemplated and within the scope of the embodiments of the present invention that the LCD and LCD system may be partially or entirely fabricated on a semiconductor integrated circuit.

While the present invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

What is claimed is:

1. A system for prewriting a video frame in a liquid crystal display, said system comprising:

a liquid crystal display (LCD) having a matrix of liquid crystal pixels, said matrix further divided into a plurality of sub-matrices of pixels;

at least one digital-to-analog converter (DAC) adapted to receive a digital input representative of an analog voltage and having an analog output adapted for applying the analog voltage to at least one of the pixels at a time;

a plurality of column switches adapted for coupling the analog output of said at least one DAC to at least one of a plurality of columns of said LCD;

a plurality of row switches adapted for selectively coupling the plurality of columns to the pixels of said LCD;

logic circuits for calculating an average voltage value to be applied to each of the plurality of sub-matrices before applying final voltage values to each of the pixels of each of the sub-matrices, wherein the average voltage value is an average of the sum of the final voltage values; and logic circuits for controlling the plurality of column switches and the plurality of row switches so that each sub-matrix may be precharged with its calculated average voltage value, then each of the pixels charged with the final voltage value representative of that portion of the video frame represented by that pixel.

2. The system of claim 1, wherein the matrix of liquid crystals is K by L, where K and L are positive integer values.

3. The system of claim 2, wherein K>L.

4. The system of claim 2, wherein K=L.

5. The system of claim 2, wherein K<L.

6. The system of claim 2, wherein each of the sub-matrices is M by N, wherein M and N are positive integer values, K is greater than or equal to M and L is greater than or equal to N.

7. The system of claim 6, wherein M is equal to N.

8. The system of claim 7, wherein M=N=8.

9. The system of claim 6, wherein M is greater than N.

10. The system of claim 6, wherein M is less than N.

11. The system of claim 2, wherein each of the sub-matrices is M by N, where M and N are positive integer values, and K is greater than or equal to M.

12. The system of claim 2, wherein each of the sub-matrices is M by N, where M and N are positive integer values, and L is greater than or equal to N.

13. The system of claim 1, further comprising said logic circuits for controlling the plurality of column switches and the plurality of row switches that charge adjacent odd and even rows of the pixels with final voltage values representative of the video frame portion represented by the odd row pixels then charge the even rows of the pixels with final voltage values representative of the video frame portion represented by the even row pixels.

14. The system of claim 1, further comprising said logic circuits for controlling the plurality of column switches and the plurality of row switches that charge adjacent odd and even rows of the pixels with final voltage values representative of the video frame portion represented by the even row pixels then charge the odd rows of the pixels with final voltage values representative of the video frame portion represented by the odd row pixels.

15. The system of claim 1, further comprising fabricating the LCD system on a semiconductor integrated circuit.

16. A method for prewriting a video frame in a liquid crystal display (LCD) having a matrix of liquid crystal pixels, said matrix further divided into a plurality of sub-matrices of pixels, said method comprising the steps of:

calculating average voltage values for each of the sub-matrices of pixels based upon an average of the sum of final voltage values for the pixels of each of the sub-matrices;

writing the calculated average voltage values to the pixels in each of the sub-matrices; and writing the final voltage values to each of the pixels.

17. The method of claim 16, further comprising the steps of:

storing the pixel final voltage values; and storing the calculated average voltage values.

18. A method for prewriting a video frame in a liquid crystal display (LCD) having a matrix of liquid crystal pixels arranged in columns and odd and even rows, said matrix further divided into a plurality of sub-matrices of pixels, said method comprising the steps of:

calculating average voltage values for each of the sub-matrices of pixels based upon an average of the sum of final voltage values for the pixels of each of the sub-matrices;

writing the calculated average voltage values to the pixels in each of the sub-matrices;

writing the odd row final voltage values to each of the adjacent odd and even rows of pixels; and writing the even row final voltage values to each of the even rows of pixels.

19. The method of claim 18, further comprising the steps of:

storing the pixel final voltage values; and storing the calculated average voltage values.

20. A method for prewriting a video frame in a liquid crystal display (LCD) having a matrix of liquid crystal pixels arranged in columns and odd and even rows, said matrix further divided into a plurality of sub-matrices of pixels, said method comprising the steps of:

calculating average voltage values for each of the sub-matrices of pixels based upon an average of the sum of final voltage values for the pixels of each of the sub-matrices;

writing the calculated average voltage values to the pixels in each of the sub-matrices;

writing the even row final voltage values to each of the adjacent odd and even rows of pixels; and writing the odd row final voltage values to each of the odd rows of pixels.

21. The method of claim 20, further comprising the steps of:

storing the pixel final voltage values; and storing the calculated average voltage values.

22. A liquid crystal display (LCD), comprising:

a matrix of liquid crystal pixels, said matrix further divided into a plurality of sub-matrices of pixels;

at least one analog-to-digital converter (DAC) adapted to receive a digital input representative of an analog voltage and having an analog output adapted for applying the analog voltage to at least one of the pixels at a time;

a plurality of column switches adapted for coupling the analog output of said at least one DAC to at least one of a plurality of columns of said LCD;

a plurality of row switches adapted for selectively coupling the plurality of columns to the pixels of said LCD;

logic circuits for calculating an average voltage value to be applied to each of the plurality of sub-matrices before applying final voltage values to each of the pixels of each of the sub-matrices, wherein the average voltage values is an average of the sum of the final voltage values; and logic circuits for controlling the plurality of column switches and the plurality of row switches so that each sub-matrix may be precharged with its calculated average voltage value, then each of the pixels charged with the final voltage value representative of that portion of the video frame represented by that pixel.

23. The LCD of claim 22, wherein the matrix of liquid crystals is K by L, where K and L are positive integer values.

24. The LCD of claim 23, wherein K>L.

25. The LCD of claim 23, wherein K=L.

26. The LCD of claim 23, wherein K<L.

27. The LCD of claim 23, wherein each of the sub-matrices is M by N, wherein M and N are positive integer values, K is greater than or equal to M and L is greater than or equal to N.

28. The LCD of claim 27, wherein M is equal to N.

29. The LCD of claim 28, wherein M=N=8.

30. The LCD of claim 27, wherein M is greater than N.

31. The LCD of claim 27, wherein M is less than N.

32. The LCD of claim 23, wherein each of the sub-matrices is M by N, where M and N are positive integer values, and K is greater than or equal to M.

33. The LCD of claim 23, wherein each of the sub-matrices is M by N, where M and N are positive integer values, and L is greater than or equal to N.

34. The LCD of claim 22, further comprising said logic circuits for controlling the plurality of column switches and the plurality of row switches that charge adjacent odd and even rows of the pixels with final voltage values representative of the video frame portion represented by the odd row pixels then charge the even rows of the pixels with final voltage values representative of the video frame portion represented by the even row pixels.

35. The LCD of claim 22, further comprising said logic circuits for controlling the plurality of column switches and the plurality of row switches that charge adjacent odd and even rows of the pixels with final voltage values representative of the video frame portion represented by the even row pixels then charge the odd rows of the pixels with final voltage values representative of the video frame portion represented by the odd row pixels.

36. The LCD of claim 22, further comprising fabricating the LCD on a semiconductor integrated circuit.

* * * * *